United States Patent [19]

Trox et al.

[11] Patent Number: 4,708,394

[45] Date of Patent: Nov. 24, 1987

[54] METHODS OF CONTROLLING THE OPERATION OF MINERAL MINING INSTALLATIONS

[75] Inventors: Uwe Trox, Ottmarsbocholt; Willy Kussel, Werne, both of Fed. Rep. of Germany

[73] Assignee: Gewerkschaft Eisenhutte Westfalia GmbH, Lunen, Fed. Rep. of Germany

[21] Appl. No.: 868,017

[22] Filed: May 29, 1986

[30] Foreign Application Priority Data

Jun. 8, 1985 [DE] Fed. Rep. of Germany ..... 3520617

[51] Int. Cl.[4] ..... E21D 23/12

[52] U.S. Cl. ..... 299/1; 299/43; 405/302

[58] Field of Search ..... 299/1, 10, 31, 42, 43; 405/302

[56] References Cited

U.S. PATENT DOCUMENTS

| | | | |
|---|---|---|---|
| 3,243,964 | 4/1966 | Thomas et al. | 299/1 X |
| 3,246,730 | 4/1966 | Bolton et al. | 299/43 |
| 3,285,015 | 11/1966 | Carnegie et al. | 405/302 |
| 4,099,781 | 7/1978 | Sawayama et al. | 299/1 |
| 4,146,271 | 3/1979 | Ward et al. | 299/1 |
| 4,451,089 | 5/1984 | Paurat et al. | 299/81 X |
| 4,451,181 | 5/1984 | Trumper et al. | 405/302 |

*Primary Examiner*—Stephen J. Novosad
*Assistant Examiner*—David J. Bagnell
*Attorney, Agent, or Firm*—Samuels, Gauthier, Stevens & Kehoe

[57] ABSTRACT

As is known mineral, e.g. coal, is won from a mineral face with the aid of a winning machine guided for movement along a conveyor composed of individual pans joined end-to-end. The conveyor is advanced towards the face behind the machine by shifting rams linked to the pans. In accordance with the invention, the rams are connected to and disconnected from a supply of pressure fluid in a controlled manner to form a group composed of a predetermined number of rams which are simultaneously charged with pressure fluid and this group progresses along the working behind the machine step-by-step in a sliding fashion within and over larger bank-push groups of rams.

6 Claims, 4 Drawing Figures

METHODS OF CONTROLLING THE OPERATION OF MINERAL MINING INSTALLATIONS

FIELD OF THE INVENTION

The present invention relates to a method of controlling the operation of a mineral winning installation and more particularly to the control of hydraulic shifting rams used to advance a conveyor in a longwall working.

BACKGROUND TO THE INVENTION

It is known to win mineral underground with the use of a longwall conveyor installed alongside the mineral face along which a winning machine is guided for movement back and forth along the face. The conveyor then transports material stripped from the face away from the working. After the passage of the winning machine the conveyor is advanced in sections up towards the face into the winning lane which has been created by stripping mineral from the face with the machine by operating hydraulic shifting rams coupled to the individual channel sections of the conveyor and engaging on roof supports which serve as abutments for the shifting forces. In known control methods, after the passage of the winning machine, the conveyor is 'snaked' up to the material face by charging a plurality of shifting rams with pressure fluid. The shifting rams are either actuated individually in succession by an operator and kept under pressure until the conveyor shifts up to the face or else they are combined into so-called 'bank-push' groups wherein the rams of one of these groups are all actuated in unison. After the conveyor has been shifted the rams are disconnected, usually in response to an operator initiated command. If the advancing forces provided by the rams is not sufficient to advance the conveyor by the desired distance, for example, because the conveyor channel sections are pushed against a ridge or step in the floor of the working, a further bank-push group is connected and the rams of the preceding bank-push are maintained under pressure until the conveyor has been advanced. In practice, it often occurs that in trying to overcome an obstacle, for example, the ridge or step mentioned above, all or at least some of the actuated rams extend out at the same time. This tends to overload the hydraulic fluid supply system and can lead to serious problems. There is a need to develop an improved method which loads the conveyor as little as possible by carefully controlling the forces imparted by the shifting rams and which avoids overloading the hydraulic supply system.

SUMMARY OF THE INVENTION

In accordance with the invention, the shifting rams over the working are divided into operational push-bank groups which are selectible through control means pertaining to an electro-hydraulic control system for the installation as is known per se and within the push-bank groups a pre-selected number (n) of shifting rams are combined into a sliding group the rams of which are simultaneously charged with pressure fluid. After a predetermined time a ram at the rear end of the sliding group relative to the direction of movement of the winning machine is disconnected and a ram at the front end of the sliding group is introduced into the sliding group. In this fashion the sliding group progresses ram by ram behind the machine. In such a method the overloading of the hydraulic supply is reliably prevented because at the same time only the predetermined number (n) of rams are ever charged with pressure fluid at the same time. The number of rams (n) making up the sliding group which progresses within a push-bank group and the number of rams forming the larger push-bank group are freely selectible. For example, a longwall working with a total of 135 roof supports and associated rams could be divided into three push-bank groups each composed of 45 shifting rams and within the individual push-bank groups the rams are combined as regards control into the sliding groups. This means that on actuation of the relevant push-bank group a specific fixed number, for example 12, of the rams in that push-bank group are simultaneously charged with pressure fluid to urge the conveyor in the direction of the mining face. After a certain period of time, for example, 5 seconds, the rear end shifting ram relative to the winning direction of the machine is disconnected and a fresh shifting ram at the front end is introduced and connected. This repeats until the shifting ram last connected has reached the limit of the push-bank group and the sliding group is then composed of $n-1$ rams. The control system which may include a computer, then ascertains whether all the shifting rams of the associated push-bank group have been fully extended. To achieve this, for example, the rams themselves can have measuring devices in the form of limit switches, permanent magnets, rotary potentiometers, ultra-sonic measuring devices or the like to signify whether or not the ram has been fully extended. If the computer discovers that not all the rams in the group have reached their prescribed limit the cycle of the sliding group is commenced anew and this operation is repeated until the number of simultaneously charged shifting rams reaches the number $n-1$. If the rams have all been extended then all the shifting rams in the previously actuated push-bank group are disconnected. The sliding cycle is made to progress into the adjacent or next following push-bank group by reconnecting the shifting rams $(n-1)$ of the previous bank-group which were previously disconnected from the hydraulic supply and by the addition of a first shifting ram in the new group to maintain the number of rams at n. The cycle then continues as before by dropping out a ram at the rear end and introducing a ram at the front end until the sliding group has reached the field limit of the next group.

The present invention generally relates to a mineral mining installation in which a winning machine is moved along a longwall conveyor composed of individual channel sections to win mineral from a face alongside the conveyor and the conveyor is advanced towards the face behind the machine as it progresses along the face by charging shifting rams with hydraulic pressure fluid; and provides an improved method of control comprising operationally dividing the rams into a plurality of bank-push groups, connecting a predetermined number of rams forming a sliding group within a bank-push group with a pressure fluid supply simultaneously for a pre-selected time, disconnecting one of the rams remote from the winning machine from the supply and connecting the next adjacent ram relative to the machine to the supply to supplement said one ram and maintain the predetermined number of rams and repeating this cycle to cause the sliding group to progress within the bank-push group and follow the machine.

By adopting a control method in accordance with the invention the hydraulic fluid supply is reliably prevented from overloading. Moreover, the conveyor is subjected to controlled forces which facilitate the shifting operation while preventing damage to the conveyor and ancilliary equipment.

The invention may be understood more readily, and various other aspects and features of the invention may become apparent, from consideration of the following description.

BRIEF DESCRIPTION OF DRAWINGS

An embodiment of the invention will now be described, by way of example only, with the reference to the accompanying drawings, wherein.

DESCRIPTION OF PREFERRED EMBODIMENT

Figure 1:
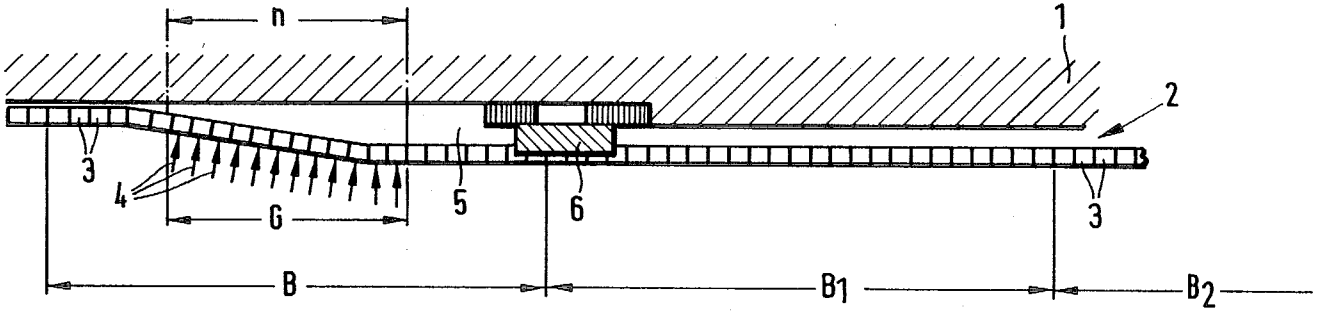
FIG. 1 is a diagrammatic plan view of a longwall working employing a mineral mining installation operating in accordance with the invention.

As shown in FIG. 1, a mineral, e.g. coal, longwall working has a seam or face 1 which is being stripped and won by a winning machine 6 moving back and forth along a longwall conveyor 2 installed alongside the mineral face 1. The machine 6 is preferably in the form of a shearer although it could be a plough. As is known, the longwall conveyor 2 is composed of individual channel sections or pans 3 joined end-to-end and interconnected for limited mobility therebetween. A plurality of shifting rams denoted by arrows 4 serve to urge the conveyor 2 selectively towards the face 1 and more particularly into the winning lane 5 left behind the machine 6 under the control of a system and method in accordance with the invention. The rams 4 are articulatedly interconnected to the individual pan 3, directly or indirectly as is known and these rams 4 are carried by abutments in the form of roof supports (not shown). These roof supports are also arranged side-by-side along the longwall working. The control system serves to charge selected rams 4 with pressure fluid to extend these rams 4 to advance the associated pans of the conveyor 2. At a later stage the rams 4 are retracted to draw up the roof supports towards the face 1. The roof supports and shifting rams 4 are combined for control purposes into groups known as bank-push groups denoted B, B1 and B2. The rams 4 within a group B, B1, B2 are operated for control purposes in a so-called sliding group G. Each sliding group G consists of a set number n of shifting rams 4.

Figure 2:
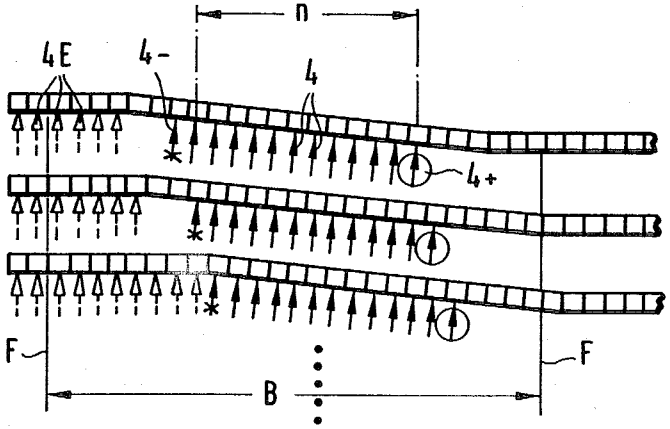
FIG. 2 depicts successive operational phases in carrying out the method according to the invention within one of the bank-push groups.
Figure 3:
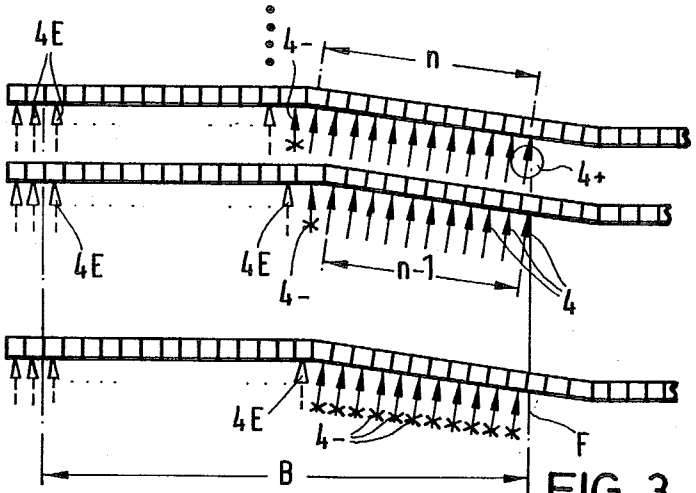
FIG. 3 depicts successive operational phases upon reaching the limit of one of the bank-push groups.
Figure 4:
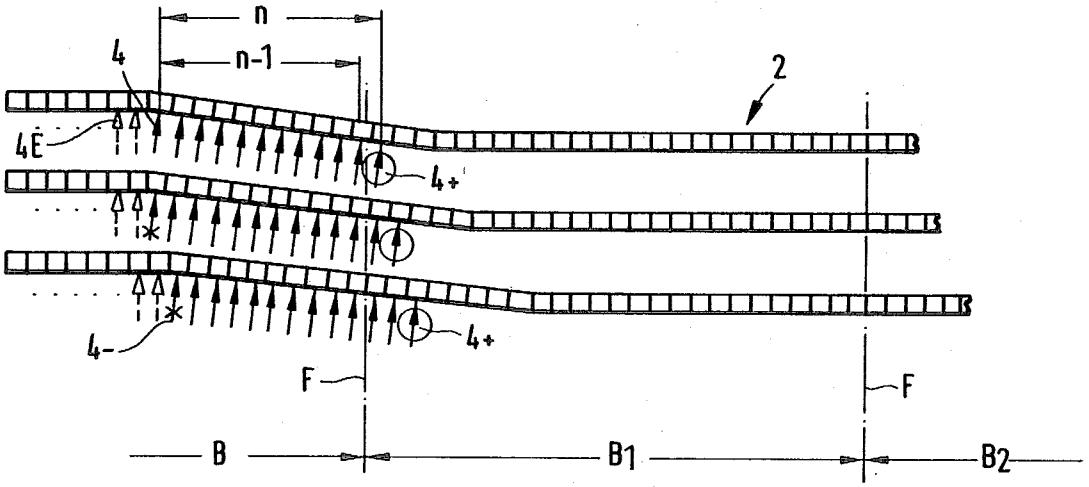
FIG. 4 depicts successive operational phases on the transition from one bank-push group to a new bank-push group.

FIGS. 2 to 4 depict individual phases of the control of the operation of the rams 4. FIG. 2 shows a preselected bank push group B with the associated sliding group G progressing from left to right behind the winning machine 6. The number n of shifting rams 4, which is 12 in this specific example, are simultaneously charged with pressure fluid at one time within the group B. After a selected further time, for example, five seconds, one ram denoted 4− is disconnected from the pressure fluid supply and a fresh ram denoted 4+ is connected to the pressure fluid supply so that the number n of shifting rams 4 operated at any one time remains constant. As a result the sliding group G shifts by one ram at a time within the bank-push group B itself from left to right. This cycle is repeated until the last shifting ram 4+ reaches the field limit F of the bank-push group B. The control system now assesses whether all the rams 4 in the group B have been fully extended, in other words, whether all the rams have adopted the position denoted 4E. If this is not the case then the entire cycle is repeated within the group B but any ram 4E which has already reached the limit of its extension is not again charged with pressure fluid. When the conveyor sections 3 associated with the group B have all been advanced, the rams 4 in the group B have all been fully extended and the number of shifting rams 4 in the group G reaches the number n−1, thus signifying that the next ram 4 to be connected to the supply lies in the next adjacent push-bank group B1, then all the rams 4 in the push-bank group B are disconnected from the hydraulic fluid supply as denoted by the crosses in FIG. 3. If the shifting process is to proceed into the next group B1 the control then passes over to the next adjacent push-bank group B1 and as shown in FIG. 4 the previously disconnected terminal group n−1 of rams 4 are reconnected to the supply but the disconnected shifting ram 4 at the left of the sliding group G in the previous push-bank group B is supplemented by the first ram 4+ in the new group B1. This cycle of operation then continues to transfer the sliding group G of n rams into the new group B1 and the cycle of operations then continues within the group B1 as before.

We claim:

1. In a mineral mining installation in which a winning machine is moved along a longwall conveyor composed of individual channel sections to win mineral from a face alongside the conveyor and the conveyor is advanced towards the face behind the machine as it progresses along the face by charging shifting rams with hydraulic pressure fluid; an improved method of control comprising operationally dividing the ram into a plurality of bank-push groups, connecting a predetermined number of rams forming a sliding group within a bank-push group with a pressure fluid supply simultaneously for a preselected time, disconnecting one of the rams remote from the winning machine from the supply and connecting a ram which is the next following within the bank-push group and nearest the machine to the supply to replace said one remote ram and maintain the predetermined number of rams and repeating this cycle to cause the sliding group to progress within the bank-push group and follow the progress of the machine.

2. A method according to claim 1, and further comprising determining when the sliding group has reached the limit of the bank-push group and if so assessing whether all the rams in the bank-push group have been fully extended and repeating the cycle of operations with the bank-push group if necessary until all the rams have been fully extended.

3. A method according to claim 1, and further comprising determining when the number of rams in the sliding group falls by one signifying the sliding group has reached the limit of the bank-push group and disconnecting all the rams in the sliding group from the supply.

4. A method according to claim 3, and further comprising reconnecting the group of rams previously disconnected to the supply, connecting the next adjacent ram constituting the first in the next bank-push group to the supply to re-establish the predetermined number of rams in the sliding group and repeating the cycle of disconnecting and connecting rams to cause the sliding group to transfer into the next bank-push group.

5. A method according to claim 1, and further comprising determining when the number of rams in the sliding group falls by one signifying the sliding group has reached the limit of the bank-push group and repeating the cycle of operations to cause the sliding group to commence and progress within the bank-push group until the number of rams in the sliding group again falls by one.

6. A method according to claim 1 wherein further control is effected by adjustably selecting at least one of the following:

(i) the number or rams making up a bank-push group;

(ii) the number of rams making up a sliding group;

(iii) the time during which the rams making up the sliding group are simultaneously charged with prssure fluid.

* * * * *